US007909214B2

(12) United States Patent
Gold et al.

(10) Patent No.: US 7,909,214 B2
(45) Date of Patent: Mar. 22, 2011

(54) SHOULDER STRAP AND WAIST BELT BAG

(75) Inventors: Nancy Gold, Niskayuna, NY (US); Christian Timm, Schenectady, NY (US); Inna Spektor, Niskayuna, NY (US)

(73) Assignee: Tough Traveler Ltd., Schenectady, NY (US)

( * ) Notice: Subject to any disclaimer, the term of this patent is extended or adjusted under 35 U.S.C. 154(b) by 1008 days.

(21) Appl. No.: 11/509,284

(22) Filed: Aug. 24, 2006

(65) Prior Publication Data

US 2007/0057002 A1 Mar. 15, 2007

Related U.S. Application Data

(60) Provisional application No. 60/715,166, filed on Sep. 9, 2005.

(51) Int. Cl.
*A45F 3/02* (2006.01)
*A45F 5/02* (2006.01)

(52) U.S. Cl. ..... 224/625; 224/607; 224/236

(58) Field of Classification Search ..... 224/625, 224/607, 236, 159

See application file for complete search history.

(56) References Cited

U.S. PATENT DOCUMENTS

| | | | | | |
|---|---|---|---|---|---|
| 240,151 | A * | 4/1881 | Lambert | 224/603 |
| 306,863 | A * | 10/1884 | Robinson | 224/633 |
| 384,736 | A * | 6/1888 | Bedford | 224/601 |
| 2,182,738 | A * | 12/1939 | Phillips | 224/677 |
| 4,878,606 | A * | 11/1989 | Miller | 224/625 |
| 5,292,042 | A * | 3/1994 | Yamaguchi et al. | 224/159 |
| 5,657,912 | A * | 8/1997 | Nakayama | 224/159 |
| 6,267,276 | B1 * | 7/2001 | Cook | 224/183 |
| 6,325,259 | B1 * | 12/2001 | Tharalson et al. | 224/161 |
| 2004/0262358 | A1 * | 12/2004 | Meyer | 224/628 |

* cited by examiner

*Primary Examiner* — Nathan J Newhouse
*Assistant Examiner* — Lester L Vanterpool

(57) ABSTRACT

The present interlocking bag and waist belt invention assists the user that must carry weight comfortably while being able to access the contents. The embodiment of the present invention teaches a soft bag, a waist belt, an optional detachable shoulder strap, and a connecting system that includes a rigid member or semi-rigid member interlocking between the waist belt and the bag through placement in looped pieces which are fixed alternatively on bag and waist belt. This invention will be of importance to walking delivery people, but the utilization will be more expansive. People young and old who are attracted by the informality of messenger bags but who want more comfort, may use the present interconnecting bag and waist belt invention for school, work, and travel.

12 Claims, 7 Drawing Sheets

SHOULDER STRAP AND WAIST BELT BAG

CROSS REFERENCE TO RELATED APPLICATIONS

Provisional Patent App. 60/715,166 file Sep. 9, 2005

STATEMENT REGARDING FED-SPONSORED R & D

This invention had no federally sponsored research and development

REFERENCE TO SEQUENCE LISTING, A TABLE, OR A COMPUTER PROGRAM LISTING APPENDIX

There is none

BACKGROUND OF THE INVENTION

There are many bags with waist belts, and there are many bags with shoulder straps, and there are many bags that have both waist belts and shoulder straps, with either removable or fixedly attached shoulder straps or waist belts, and many bags with loops for holding removable waist belts. These bags may allow carrying what is needed, but they do not always keep the wearer comfortable or the contents easily accessible or usable while the bag is being worn by the person. These bags may even keep the load primarily on the shoulder, with use of the shoulder strap. If the size or weight of the load is large, these bags can be quite uncomfortable. Also, the bags may become unwieldy, making walking difficult due to the weight felt on shoulder or—without shoulder strap—on the hips, and there may be awkwardness in the case of a bag hanging below the waist of a bag hitting the lower back and/or leg area of the wearer. Sagging bags may also make access to or use of contents difficult, as the contents move to the lower center point of the bag in the case of a bag with one large or with a plethora of large compartments or pockets. If it is attempted to bypass this gathering of contents by utilizing small interior or exterior compartment or pocket, then it may be difficult to access the individual content items, and the bag may yet sag.

A hard bag may solve some of the organizational or access problems, but a hard bag presents problems of discomfort and inaccessibility. A hard case or bag is difficult to wear close to the human body because, while the case or bag may be rigidly geometric, the human body is flexible and unevenly curved, making carrying heavy if the weight is on shoulder, or impossible to bend or move if the weight is against back or hip.

BRIEF SUMMARY OF THE INVENTION

The present interconnected supported waist belt and supported bag invention solves the problems of carrying weight and accessibility while providing comfort for shoulder and back. This invention allows a bag to be connected to a waist belt where the human waist most bends—at the waist or hips—and for contents to be accessible and comfortable while the bag is being worn, without sagging or weight discomfort. In the instance of the present embodiment, a system of web holders and interlocking elastic holders, threaded by an aluminum rod, keeps the bag supportively attached to the waist belt at one area and there is support of waist belt and support of bag.

The bag in this embodiment is kept partially rigid through the aluminum rod that is held by web loops that are on the back of the bag, while the bag is connected to the waist belt through placement of the same aluminum rod through elastic loops that are on the front of the waist belt. The loops on bag and on waist belt are alternately spaced. As the aluminum rod only meets the waist belt in a small area, the waist belt remains curved against the wearer's body. This invention distributes weight primarily to the wearer's hips. The bag is slidably fixed on the waist belt, but all sections of the contents can be accessed by the user directly if the bag is on the users front, or may be accessed easily by movement of the waist belt to the user's front or hips. The waist belt is curved and tightened to the user's body while the bag is straight at the area where the aluminum rod is placed.

In the present embodiment, the optional detachable shoulder strap allows the waist belt to stay even closer to the user's body, as here the shoulder strap is attached directly to the d-rings on the waist belt. Most of the weight is at the user's hips rather than at the user's shoulders, and the shoulder strap also may not be used with light loads. The rigidity of at least part of the bag, in addition to where the bag is placed, allows the wearer to walk without awkwardness or discomfort. The connector rod threaded through alternating web and elastic loops provides both rigidity and shock absorption when the wearer is walking.

To allow quick-discard of the bag in the event of an emergency, and also for ease of wearing when the invention is being used, there are connecting points at both where the shoulder strap meets the waist belt for connection and where the waist belt meets with itself for waist belt closure.

While the present embodiment of the invention is thought to be best functioning when the bag is worn at the side, the hag is partially movable to the front of the wearer; also it is possible that the user will wear the bag at his or her back, turning the hag when access to the bag's interior is needed. If the optional shoulder strap in this embodiment is not used and the entire bag is secured on the user by the waist belt on the user's back, then the bag may be turned completely to the user's front for access to the bag interior. Although the present invention uses a bag of large capacity and rectangular horizontal dimensions, a myriad of sizes and dimensions may be conceived. Simple changes such as the material of shoulder strap in cotton and tricot rather than padded nylon, may be imagined, as well as more complex changes in material. The waist belt may be solidly padded nylon, it may have alternating padding it may have stays with or without padding, or it may have a plastic basis; other changes to the waist belt in structure and in material may also be imagined. Likewise, the bag or case itself may fully padded, may be a framed structure with solidly or with alternating thinner areas, may have an unframed unpadded structure with one rigid area, or may have alternative structures. Even a rigid case may be used. The invention may have an integral bag, or it may have an existing bag modified by the addition of attachment elastic pieces, aluminum pieces, plastic pieces, and/or other substitutions to complete the invention. Optional compression straps; compartments both in the interior and on the exterior of the bag or case; different arrangements of shoulder strap or even the addition of a second strap; compartments on the waist belt; these and other modifications may be imagined by one practiced in the arts. Likewise, alternative placements and use of plastic hardware, web, hook and loop, quick-release buckles, bolts, screws, nuts, clips, and other connecting materials, both invented or to come, are imagined.

A person practiced in the art may imagine a number of deviations in the scope of this invention. One imagined deviation is a substitution of the bag for a more shelf-like creation which would be useful to people with injuries that need time for rest, such as an injured arm: Additional padding, webbing, and means of attachment of additional pieces could allow superior rest for the injured limb. Other deviations come to mind: a child carrier; a dog or other small pet carrier; a book or papers carrier without the external bag but instead with a grill-like cage or other means of containment, and others. As new raw materials are invented, substitutions may be made while using or otherwise keeping the ideas of the present invention. Gel materials with imbedded shorter pieces such as aluminum, plastic, and other materials may be imagined, along with, or independent of additional constructions and material changes as may be imagined by one practiced in the arts.

DETAILED DESCRIPTION

Figure 1:
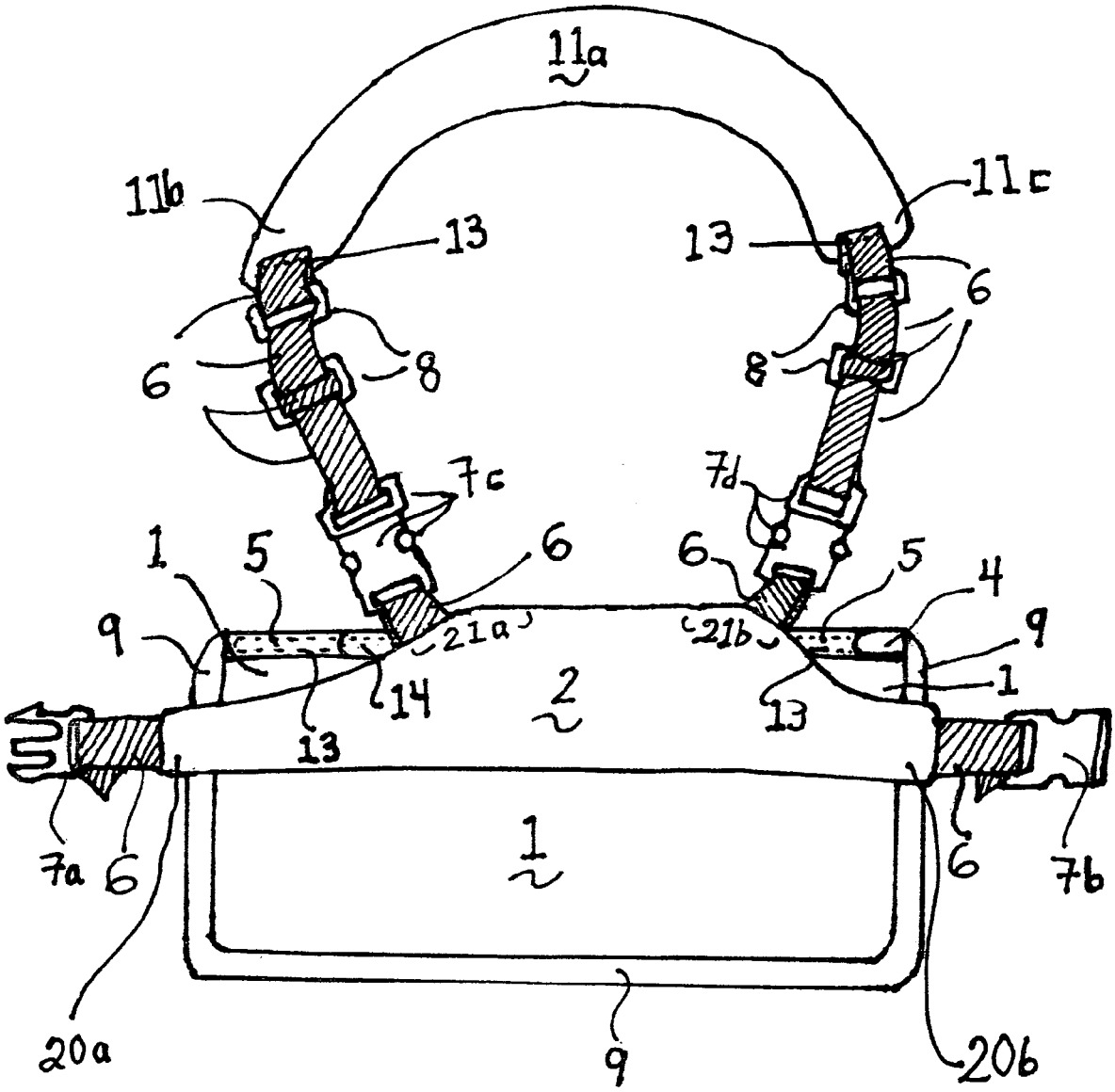
FIG. 1 Back view of the present shoulder strap and waist belt bag invention
Figure 2:
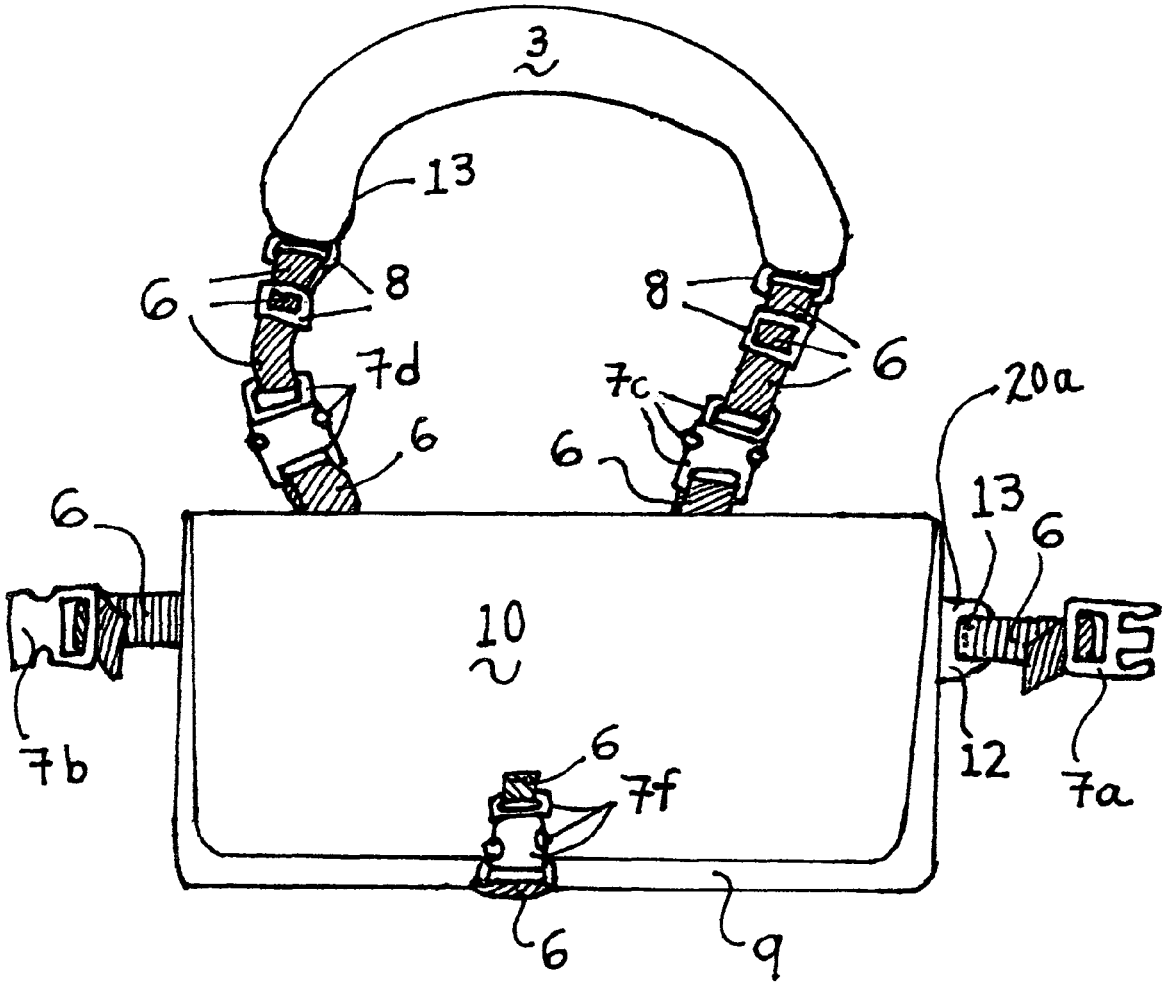
FIG. 2 Front view the present invention
Figure 3:
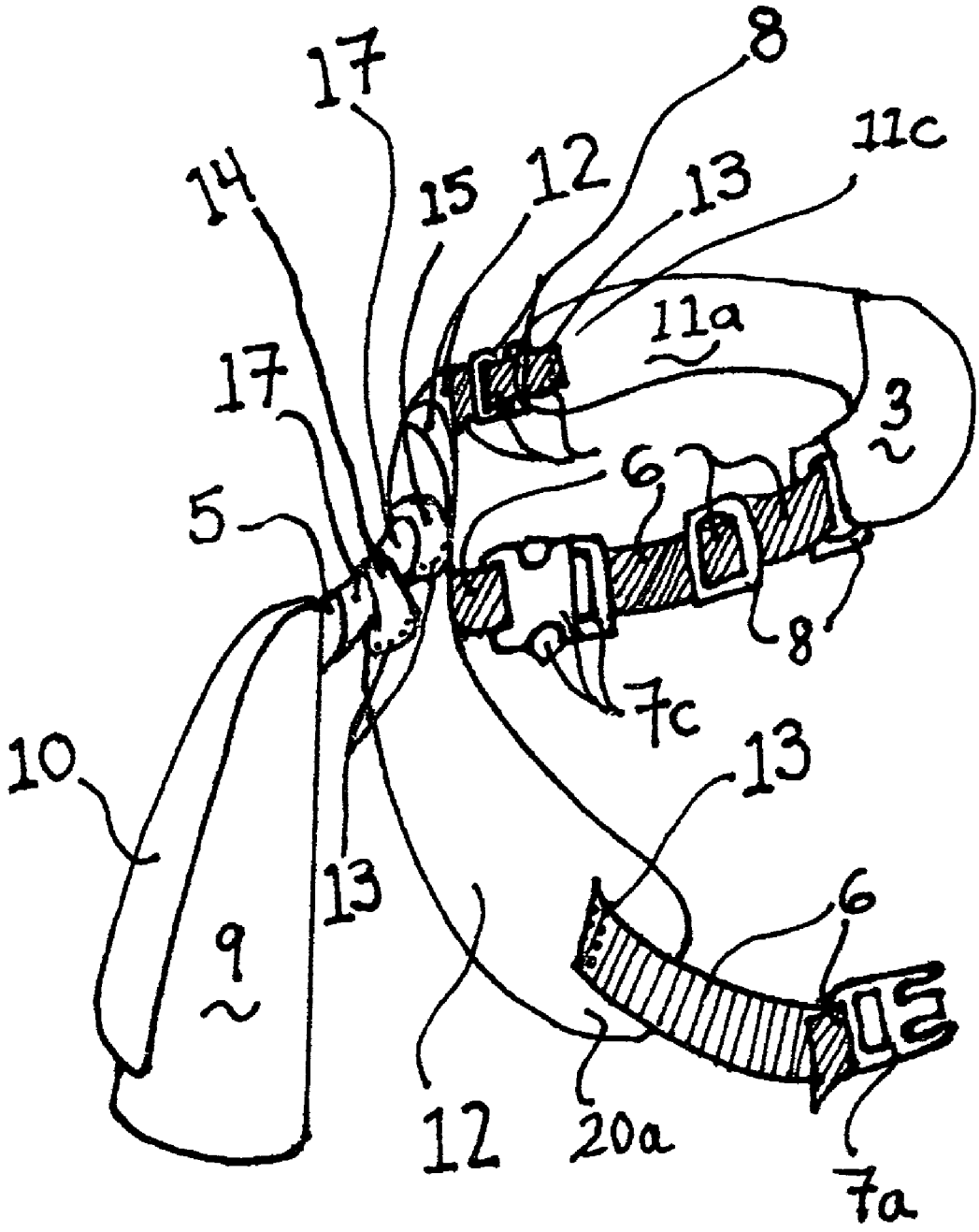
FIG. 3 Side view showing the bag stretched away from the waist belt, for the purpose of illustration FIG. 4 Back of bag when it is not connected to waist belt or to shoulder strap, for the purpose of illustration FIG. 5 Front of bag when it is not connected to waist belt or to shoulder bag, for the purpose of illustration FIG. 6 Aluminum rod that is used in the present invention, shown removed from the full invention, for the purpose of illustration FIG. 7 Front view of person wearing the present invention FIG. 8 Back view of person wearing the present invention
Figure 4:
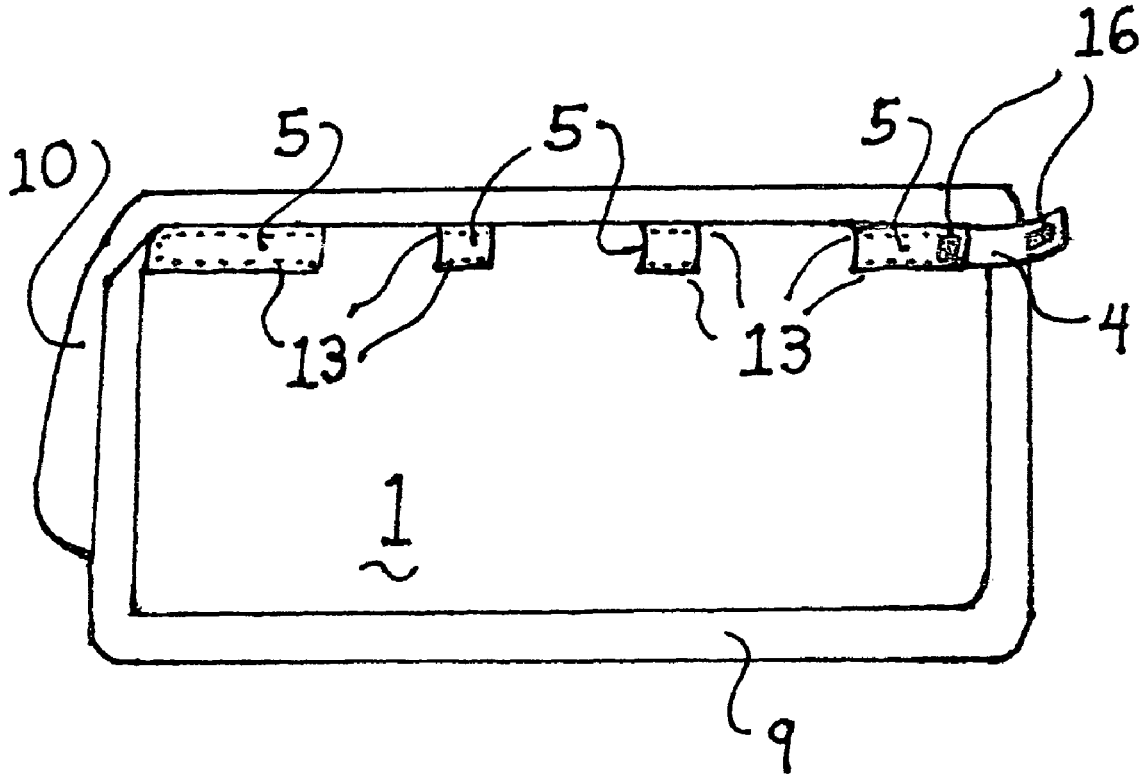
Figure 5:
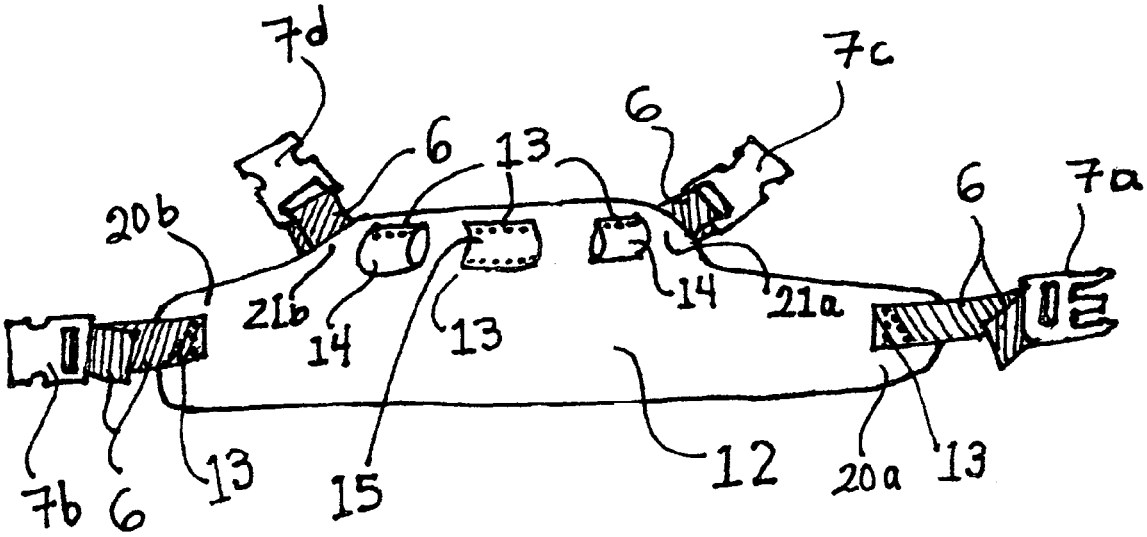
Figure 6:
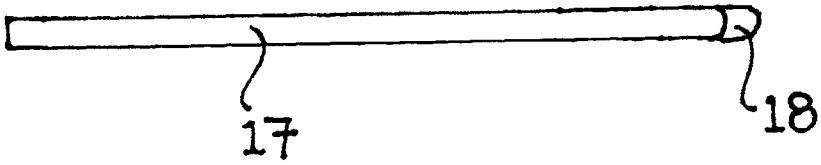
Figure 7:
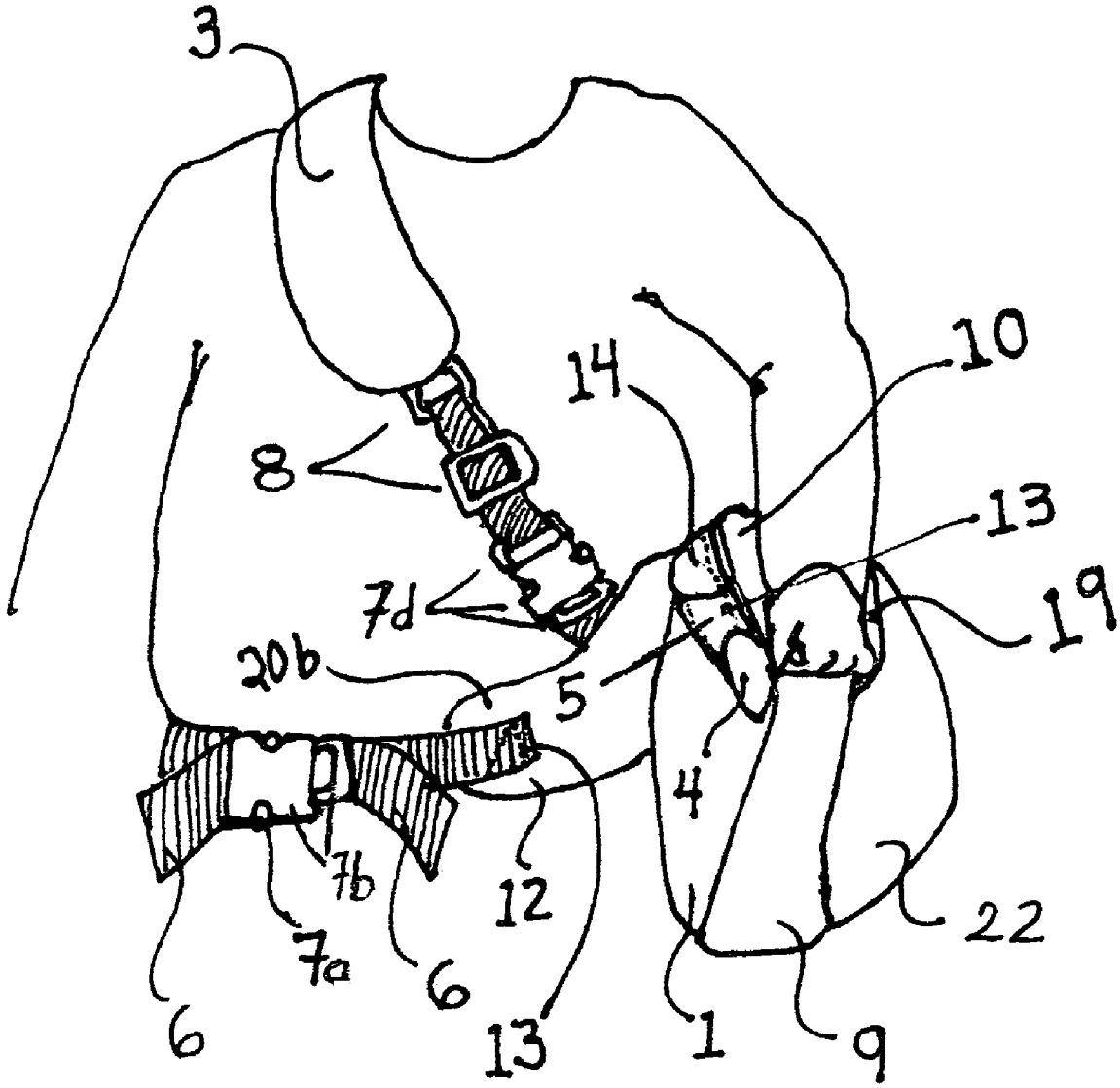
Figure 8:
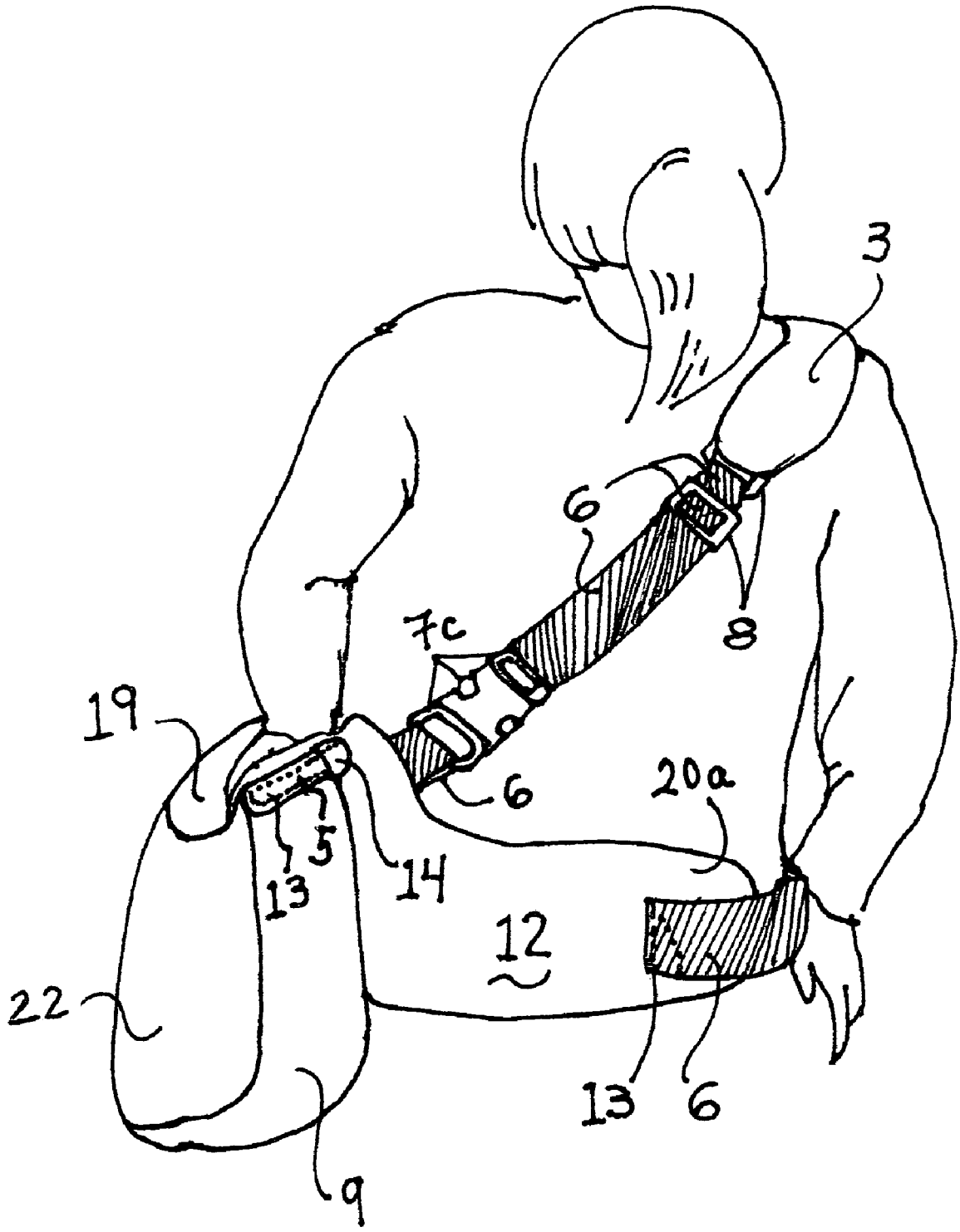

This embodiment of the present shoulder strap and waist belt bag invention has three main structures that interconnect to form the embodiment. The waist belt underside 2, waist belt upper-side 12 connects to itself, or disconnects to itself at ends 20*a*, 20*b* with the use of quick-release buckle 7*a*, 7*b*, which attach by web pieces 6 and stitching 13. Towards the top of the waist belt 21*a*, 21*b*, web pieces 6 connect quick-release buckles 7*c*, 7*d*, which connect, or disconnect, with upper-side shoulder strap 3 and underside shoulder strap ends 11*b*, 11*c*. The web 6 of the shoulder strap 3, 11*a* is adjustable through the use of hardware 8.

The bag is comprised of bag back 1, bag gusset 9, bag flap 10, bag inside 19, and hag front 22. At bag back 1 there are four web tunnels 5, with stitching 13, to allow passage of aluminum rod 17. There is a flap 4 to prevent unintentional removal or dislodgement of aluminum rod 17 from web tunnels 5. The flap 4 is closed by hook and loop 16, and there is an end cap 18 on the aluminum rod 17 to allow easier-on-the-hands insertion of the aluminum rod 17. On waist belt upper-side 12 there are two elastic loops 14 and the elastic tunnel 15, both with stitching 13, through which aluminum rod 17 is inserted alternatively with web tunnels 5 of bag back 1 forming the direct connection of the waist belt upper-side 12 and the bag back 1 of this embodiment of the present shoulder strap and waist belt bag invention, and coincidentally forming the fuller connection of the waist belt underside 2, waist belt upper-side 12 and the bag 1, 9, 10, 19, 22. On bag gusset 9, web 6 holds quick-release buckle 7*f* to allow closure of bag flap 10.

We claim:

1. A wearable apparatus comprising:

a container having a front wall, a back wall, a first side wall, a second side wall, all interconnected with a bottom wall, with the back wall comprising at least four container loops positioned in a row adjacent to the top edge of the back wall, said container loops including a right container loop located adjacent to said first side wall, a first middle container loop located adjacent to the midpoint of said back wall, a second middle container loop located adjacent to said first middle container loop, and a left container loop located adjacent to said second side wall, with a space between each of said container loops such that no container loop is in direct contact with another container loop;

a waist belt for encircling a person's waist and permitting said container to be positioned at one side of the person, said waist belt comprising a strap with a distal end and a proximal end, and comprising a means of attaching the proximal end to the distal end, the middle part of the waist belt being of a proportionately greater width than the said proximal end and said distal end, and said middle part of the waist belt comprising at least three waistbelt loops, said waistbelt loops consisting of a right waistbelt loop positioned to correspond with the location of the space between said right container loop and said first middle container loop, a middle waistbelt loop positioned to correspond with the location of the space between said first middle container loop and said second middle container loop and a left waistbelt loop positioned to correspond with the location of the space between said second middle container loop and said left container loop;

and a rigid rod or stay arranged to pass in sequence through said right container loop, said right waistbelt loop, said first middle container loop, said middle waistbelt loop, said second middle container loop, said left waistbelt loop, and said left container loop, in such a way as to bring the back wall of the container into direct contact with the waist belt while permitting the weight of the container to be distributed along the rigid rod or stay.

2. The apparatus of claim 1, further comprising a shoulder strap for further supporting the weight of said container, having a proximal end non-fixedly attached at an oblique angle to the waist belt at a point substantially adjacent to the first side wall of the container and a distal end non-fixedly attached at an oblique angle to the waist belt at a point substantially adjacent to the second side wall of the container, permitting said shoulder strap to be worn diagonally across the torso of a wearer and adjacent to the person's shoulder opposite the side adjacent to the container.

3. The apparatus of claim 2, wherein the length of the shoulder strap is adjustable.

4. The apparatus of claim 1, wherein at least one loop on the container portion is comprised of web, elastic, or cloth or other flexible material.

5. The apparatus of claim 2, wherein at least one loop on the container portion is comprised of web, elastic, or cloth or other flexible material.

6. The apparatus of claim 1, wherein the container portion is adapted to carry an infant.

7. The apparatus of claim 1, wherein the container portion is adapted to carry an animal.

8. A wearable apparatus comprising:

a container having a from wall, a back wall, a first side wall, a second side wall, all interconnected with a bottom wall, with the back wall comprising at least three container loops positioned in a row adjacent to the top edge of the back wall, said container loops including a right container loop located adjacent to said first side wall, a middle container loop located adjacent to the midpoint of said back wall, and a left container loop located adjacent to said second side wall, with a space between each of said container loops such that no container loop is in direct contact with another container loop;

a waist belt for encircling a person's waist and permitting said container to be positioned at one side of the person, said waist belt comprising a strap with a distal end and a proximal end, and comprising a means of attaching the proximal end to the distal end, and at least two waistbelt loops, said waistbelt loops consisting of a right waistbelt loop positioned to correspond with the location of the space between said right container loop and said middle container loop, and a left waistbelt loop positioned to correspond with the location of the space between said middle container loop and said left container loop and a rigid rod or stay arranged to pass in sequence through said right container loop, said right waistbelt loop, said middle container loop, said left waistbelt loop, and said left container loop, in such a way as to bring the back wall of the container into direct contact with the waist belt while permitting the weight of the container to be distributed along the rigid rod or stay.

9. The apparatus of claim 1, wherein at least one wall of the container is supported by a rigid or semi-rigid material.

10. The apparatus of claim 1, wherein a support portion is adapted to support an arm of a wearer.

11. The apparatus of claim 2, wherein the shoulder strap member is fixedly attached to the waist belt and wherein the length of the shoulder strap is adjustable.

12. The apparatus of claim 1, wherein the waist belt is adjustable in length.

* * * * *